US008010003B2

(12) United States Patent
Son et al.

(10) Patent No.: US 8,010,003 B2
(45) Date of Patent: Aug. 30, 2011

(54) APPARATUS TO PREVENT CONTAMINATION OF FIXING UNIT IN IMAGE FORMING APPARATUS AND METHOD OF USING SUCH

(75) Inventors: Jung Woo Son, Seoul (KR); Soo Cheol Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 631 days.

(21) Appl. No.: 11/854,905

(22) Filed: Sep. 13, 2007

(65) Prior Publication Data

US 2008/0138093 A1 Jun. 12, 2008

(30) Foreign Application Priority Data

Dec. 12, 2006 (KR) ..... 10-2006-0126380

(51) Int. Cl.
*G03G 15/043* (2006.01)

(52) U.S. Cl. ..... 399/52

(58) Field of Classification Search ..... 399/45, 399/68, 396, 49, 51, 52; 347/9, 16, 102
See application file for complete search history.

(56) References Cited

U.S. PATENT DOCUMENTS

| | | | | |
|---|---|---|---|---|
| 5,565,972 | A * | 10/1996 | Honda et al. | 399/384 |
| 5,638,098 | A * | 6/1997 | Iwata et al. | 347/9 |
| 6,785,480 | B2 * | 8/2004 | Toyohara et al. | 399/49 |
| 6,900,906 | B1 | 5/2005 | Tanaka | |
| 2005/0063720 | A1 * | 3/2005 | Fujita et al. | 399/45 |

FOREIGN PATENT DOCUMENTS

JP 2001-160899 6/2001

OTHER PUBLICATIONS

Korean Office Action dated Mar. 18, 2011, issued in Korean Patent Application No. 10-2006-0126380.

* cited by examiner

*Primary Examiner* — Hoang Ngo
(74) *Attorney, Agent, or Firm* — Staas & Halsey LLP

(57) ABSTRACT

When the density of a toner image of a leading end of a printing sheet is no less than a predetermined reference density, a printing start time is delayed or printing data is deleted so that printing data is not printed in the leading end of the sheet. When the printing is performed in a state where a cover used for copying is opened, a printing start time is delayed or the printing data of the leading end of the printing sheet is deleted. Therefore, it is possible to prevent a fixing unit from being contaminated due to the toner image transferred to the leading end of the printing sheet.

16 Claims, 8 Drawing Sheets

APPARATUS TO PREVENT CONTAMINATION OF FIXING UNIT IN IMAGE FORMING APPARATUS AND METHOD OF USING SUCH

CROSS-REFERENCE TO RELATED APPLICATION

This application claims the benefit of Korean Application No. 2006-126380, filed on Dec. 12, 2006, in the Korean Intellectual Property Office, the disclosure of which is incorporated herein by reference.

BACKGROUND OF THE INVENTION

1. Field of the Invention

Aspects of the present invention relate to an apparatus for preventing a fixing unit of an image forming apparatus from being contaminated by a toner image in the leading end of a sheet and a method of using such.

2. Description of the Related Art

In an electro-photographic image forming apparatus, an electrostatic latent image is formed on a photosensitive drum, a visible image is developed by adhering a toner to a developer, the visible image is transferred to a printing sheet, and the printing sheet to which the visible image is transferred passes through a fixing unit so that the transferred image is fixed before the printing sheet is discharged. The fixing unit employed in the electro-photographic image forming apparatus applies heat and pressure to the printing sheet to which the toner image is transferred so that the toner image is fixed to the printing sheet. The fixing unit includes a heating roller and a pressing roller which are installed in the feeding path of the printing sheet.

As illustrated in FIG. 1, a pressing roller 8 and a heating roller 9 are installed in the feeding path T of a printing sheet, such as a sheet of paper, a transparency sheet, etc., to face each other. The printing sheets are fed one by one from a sheet cassette (not shown) to the pressing roller 8 and the heating roller 9 by feeding rollers 10.

Reference numeral 11 indicates a sheet sensor to detect the printing sheet. Reference numeral L1 indicates a feeding distance from the sheet cassette to the sheet sensor 11 and reference numeral L2 indicates a feeding distance from the sheet sensor 11 to the position where the printing sheet enters between the pressing roller 8 and the heating roller 9.

The fixing unit includes a sheet guide member 7, also known as a "claw." As illustrated in FIG. 2A, the sheet guide member 7 is installed so that the leading end thereof contacts the surface of the heating roller 9 which has a heater 9*a*, resulting in a smooth discharge of the printing sheet 6, without curling of the printing sheet 6.

When the printing sheet 6 having a toner image 5 passes through between the pressing roller 8 and the heating roller 9, toner sludge sticks to the sheet guide member 7 and the heating roller 9. Since the leading end of the printing sheet 6 contacts the sheet guide member 7 while passing between the heating roller 9 and the pressing roller 8, the sheet guide member 7 becomes more and more contaminated as the toner image density increases.

As printing is performed and the number of printing sheets 6 passing through the fixing unit increases, the fixing unit becomes severely contaminated, a consequence which is difficult to prevent. If a user wishes to prevent the fixing unit from being contaminated, the density of the toner image transferred to the leading end of the printing sheet 6 should be decreased.

When a copying operation is performed using a multifunction printer having a copy function, and a cover of the multifunction printer is not completely closed, for example, due to the carelessness of a user, the leading end of the printing sheet 6 is exposed to light. As a result of this exposure, the toner image of the leading end of the printing sheet 6 is printed in a black color having a considerably high density, which further accelerates the contamination of the fixing unit.

When users neglect the contamination of the fixing unit, the contamination material attached to the sheet guide member 7 solidifies due to the increase in temperature caused during the fixing process. When the solidified contamination material on the sheet guide member 7 claws down the printing sheet 6 to be discharged, an undesired vertical black line is printed on the printing sheet 6 and the printing sheet 6 may get jammed.

SUMMARY OF THE INVENTION

Aspects of the present invention have been made in view of the above-mentioned problems. An aspect of the invention provides an apparatus for preventing a fixing unit of an image forming apparatus from being contaminated by delaying a printing start time according to the image density of a leading end of a printing sheet, and a method of using thereof.

Additional aspects and/or advantages of the invention will be set forth in part in the description which follows and, in part, will be obvious from the description, or may be learned by practice of the invention.

Another aspect of the invention provides an apparatus for preventing a fixing unit of an image forming apparatus from being contaminated by intentionally deleting printing data of a leading end of a printing sheet according to the image density of the leading end of the printing sheet and a method thereof.

In accordance with the above aspects, an apparatus to prevent a fixing unit of an image forming apparatus from being contaminated according to an aspect of the present invention includes a storage unit to store printing data, a printer module to perform a printing operation by printing the printing data onto a printing sheet, and a controller to set a printing start time according to a printing density corresponding to a leading end of the printing sheet and to control the printer module to start performing the printing operation according to the set printing start time.

According to an aspect, the apparatus further includes a host computer to transmit the printing data, and an interface which connects the host computer to the controller, wherein the printing data is transmitted from the host computer through the interface to the storage unit, to store the printing data.

According to an aspect, the controller calculates the printing density using the printing data.

According to an aspect, the controller delays the printing start time when the printing density is greater than a predetermined reference density.

According to an aspect, the printing start time is a time at which the printing data is initially transferred to the printing sheet.

An apparatus to prevent a fixing unit of an image forming apparatus from being contaminated according to another aspect of the present invention includes: a storage unit to store printing data, a printer module to perform a printing operation by printing the printing data onto a printing sheet, and a controller to set a printing region for printing the printing data according to a printing density of a leading end of the printing sheet and to control the printer module to start performing the printing operation according to the set printing region.

According to another aspect, the apparatus further includes a copier module connected to the controller to transmit data of material to be copied to the storage unit, wherein the storage unit stores the data as the printing data.

According to another aspect, the apparatus further includes a cover sensor to detect whether a cover on the image forming apparatus is closed, wherein when the cover sensor detects that the printing data is being printed in a state where the cover is opened, the controller controls the printing module to exclude the leading end of the printing sheet from the printing region.

An apparatus to prevent a fixing unit of an image forming apparatus from being contaminated according to another aspect of the present invention includes a host computer to transmit printing data corresponding to material to be printed, a copier module to transmit copying data corresponding material to be copied, a cover sensor to detect whether a cover on the image forming apparatus is closed, a storage unit to store the printing data transmitted from the host computer and the copying data transmitted from the copier module, a printer module to print the printing data or the copying data onto a printing sheet, a sheet guide member to guide the sheet passing through the fixing unit, and a controller to set a printing start time or a printing region according to a density of the toner image to be transferred to a leading end of the printing sheet.

According to another aspect, the controller delays the printing start time when the density of the toner image is greater than a predetermined reference density.

According to another aspect, when the printing data or copying data is printed in a state where the cover is opened, the controller sets the printing region to exclude a masking region corresponding to the leading end of the printing sheet.

A method of preventing a fixing unit of an image forming apparatus from being contaminated according to another aspect of the present invention includes storing printing data received from a host computer, calculating a density of a toner image to be printed at a leading end of a printed sheet, using the printing data, setting a printing start time according to the calculated density of the toner image, and performing printing according to the set printing start time.

According to another aspect, the printing start time is delayed when the calculated density of the toner image is greater than a predetermined reference density.

According to another aspect, the printing start time is a time at which printing is initially performed on the printing sheet.

A method of preventing a fixing unit of an image forming apparatus from being contaminated according to another aspect of the present invention includes storing printing data received from a copier module or a host computer, detecting whether a cover disposed on the copier module to be used for copying is opened, excluding a masking region corresponding to a leading end of a printing sheet from a printing region when the printing data is printed in a state where the cover is opened, and printing the printing data according to the set printed region.

According to another aspect, the excluding of the masking region includes deleting the printing data of the excluded masking region.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
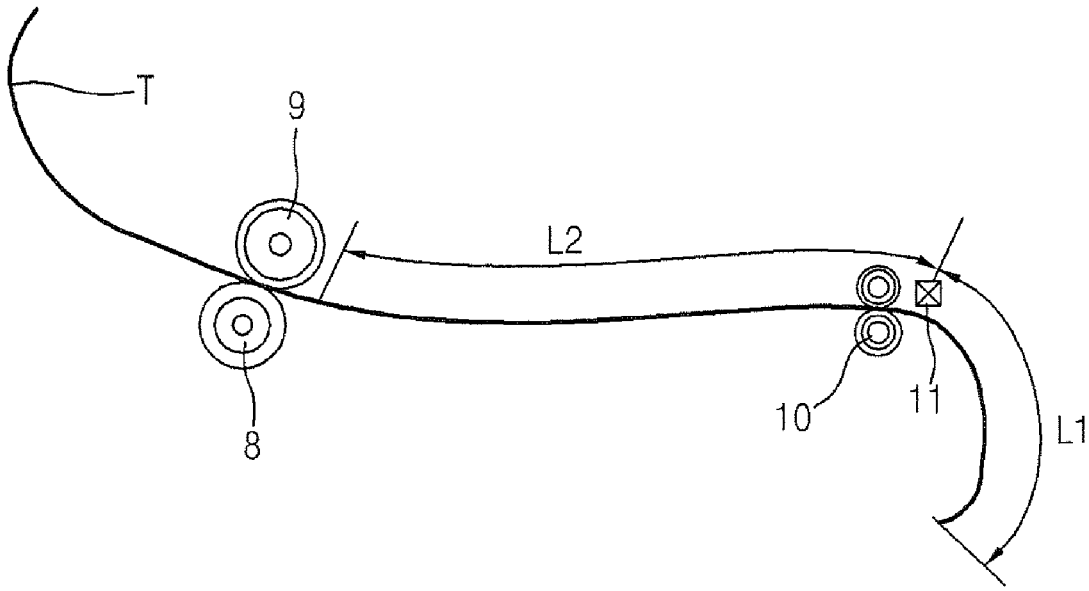
FIG. 1 is a view illustrating a feeding path of a printing sheet.
Figure 2A:
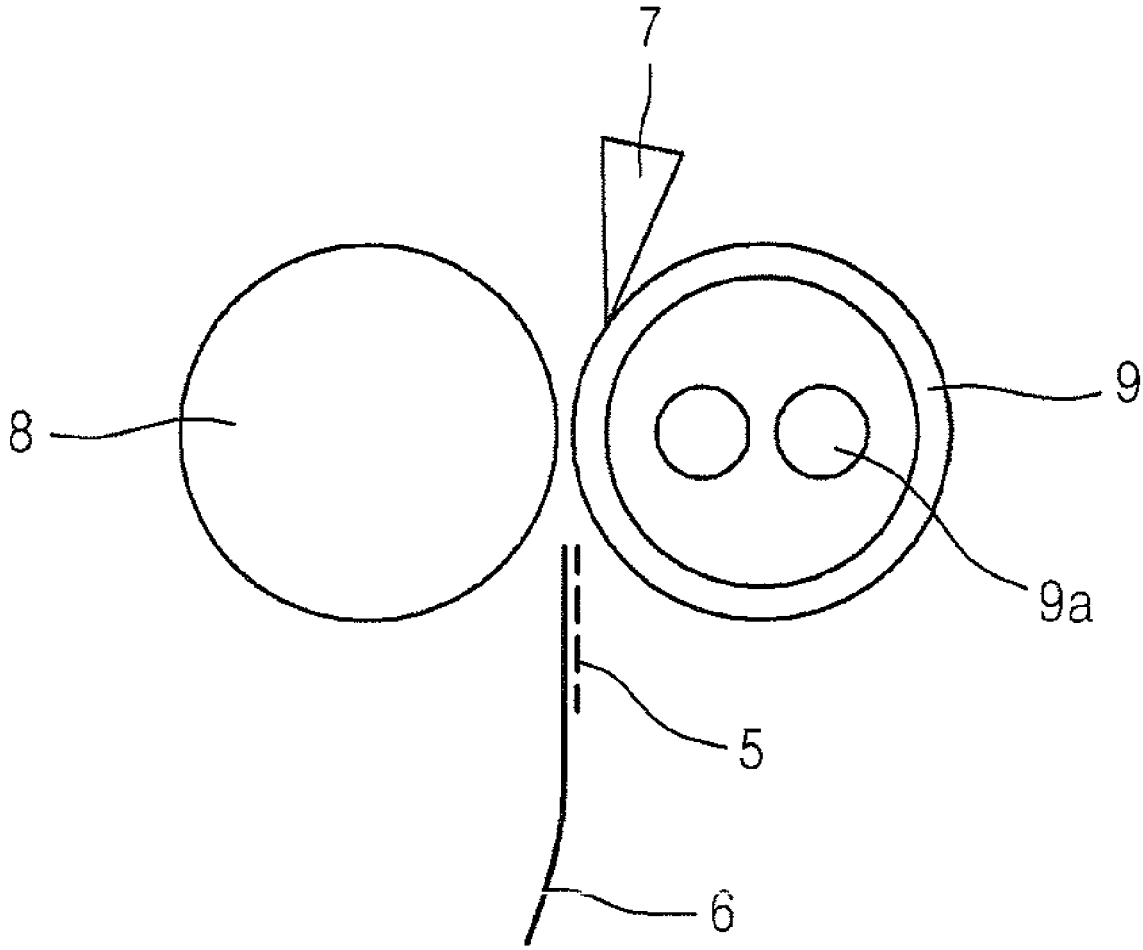
FIG. 2A is a view illustrating a state in which the leading end of the printing sheet enters between a pressing roller and a heating roller.
Figure 2B:
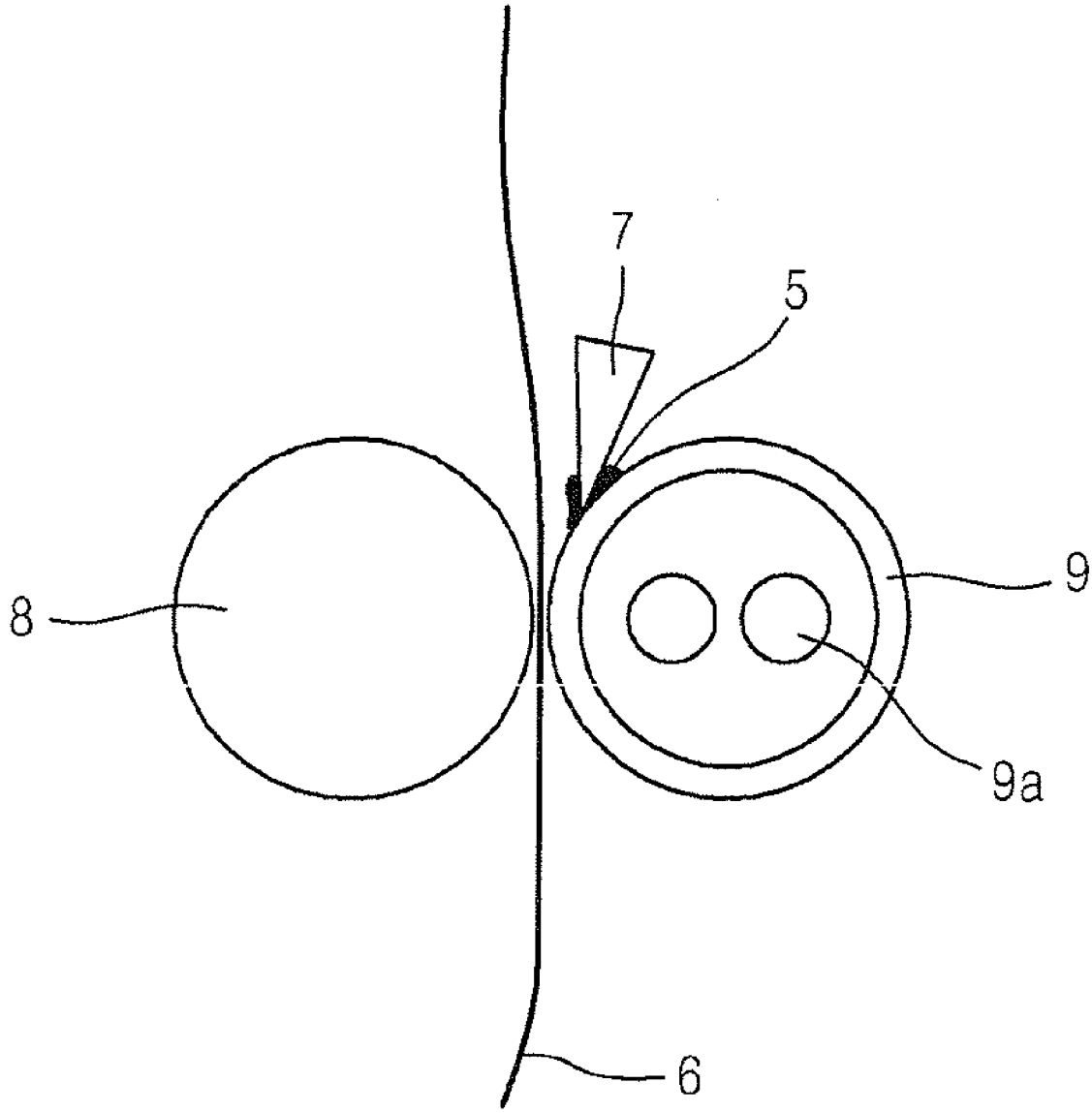
FIG. 2B is a view illustrating a situation in which a sheet guide member is contaminated by a toner image of the printing sheet passing between the pressing roller and the heating roller illustrated in FIG. 2A.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

In a detailed description, a multifunction printer is connected to a host computer 100 to print out printing sheets 6, which may be, for example, sheets of paper, transparency sheets, etc., based on printing data and material to be copied.

Figure 3:
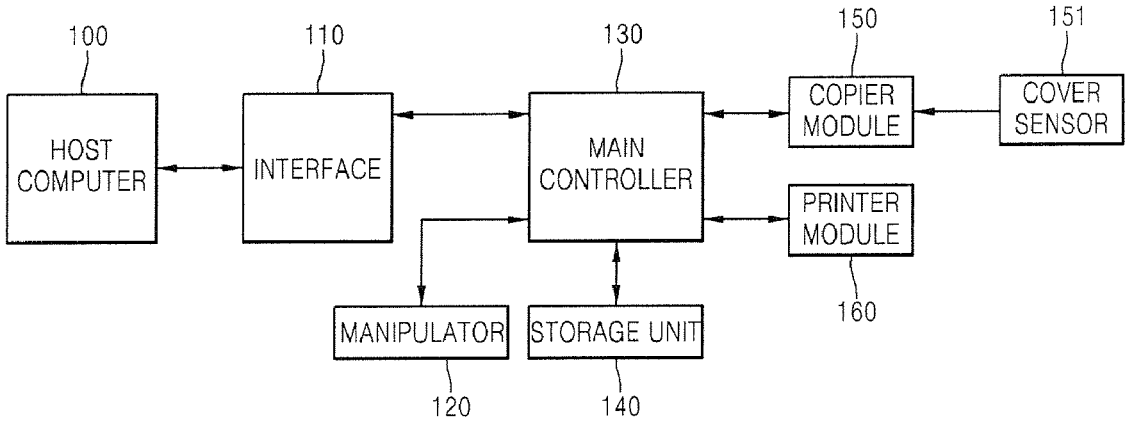
FIG. 3 is a block diagram illustrating an apparatus to prevent contamination of a fixing unit of an image forming apparatus, according to an embodiment of the present invention.

As illustrated in FIG. 3, a main controller 130 which controls overall printing operations is connected to a host computer 100 via an interface 110. The main controller 130 transmits and receives control commands to and from a copier module 150 and a printer module 160 in order to perform the corresponding functions of copying the printing sheet 6 and printing the printing sheet 6.

A cover sensor 151 detects whether a cover (not shown) of the multifunction printer is closed, and transmits the information about whether the cover (not shown) is closed to the main controller 130 through the copier module 150. The cover (not shown) may be any kind of cover commonly used with multifunction printers, and preferably has an opening which the printing sheet 6 is inserted into in order to copy the printing sheet 6. When the printing sheet 6 is inserted into the cover (not shown), printing data from the printing sheet 6 is transmitted through the copier module 150. Printing data which is transmitted through the copier module 150 is also referred to as "copying data" to distinguish this data from the printing data transmitted by the host computer 100.

A manipulator 120 preferably includes a keypad and a liquid crystal display (LCD) and is used by a user to input commands and settings to the multifunction printer. The manipulator 120 can be implemented as a remote controller, can be integrally formed onto the multifunction printer, or can be a combination of the two.

A storage unit 140 stores the printing data on which the printing images are based, and control programs used to control the operation of the multifunction apparatus. A user can use the control programs through the control of the main controller 130.

When a user enters a printing command into the host computer 100, the printing command and printing data is transmitted from the host computer 100 through the interface 110 to the main controller 130. Then, the main controller 130 temporarily stores the printing data received through the interface 110 in the storage unit 140 in response to the printing command output from the host computer 100.

Figure 4:
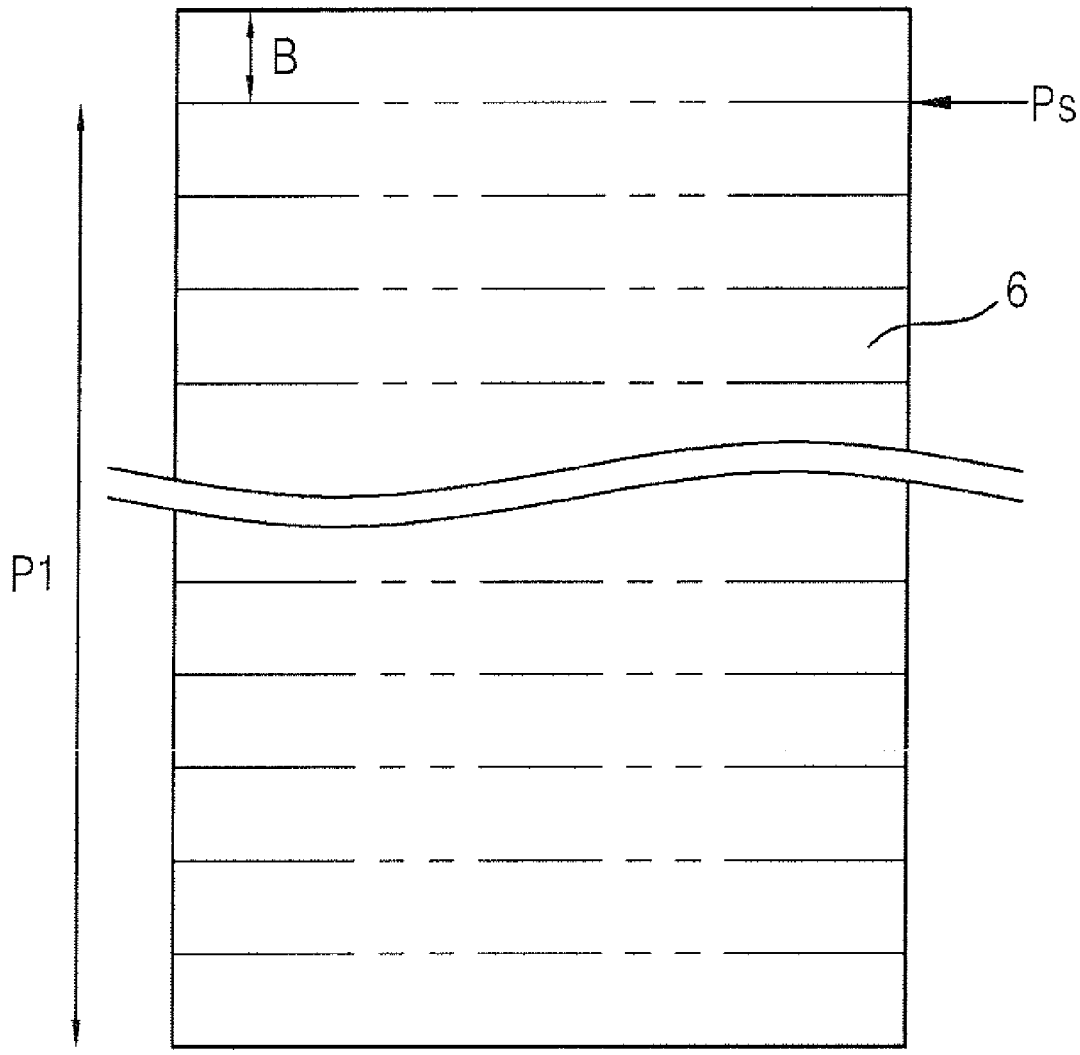
FIG. 4 is a view illustrating an effective printing region in a situation where a printing start time is delayed in order to prevent a sheet guide member from being contaminated, according to an embodiment of the present invention.

As illustrated in FIG. 4, in the printing data, when the printing region of a printing sheet 6 is divided into units of a band B which each has a predetermined region, it is possible to calculate the density of a toner image printed in units of the band B. Preferably, a length of one band is set as 12 mm. However, it is understood that the bands B may be longer or shorter than 12 mm, and that the bands B are not required to be the same length. When the printing data, which includes text, graphics, and images that are printed on the bands B, is displayed, the density of the toner image is calculated in accordance with the toner consumption of the band B.

When the density of the toner image of the leading end of the printing sheet 6 is calculated based on the printing data, the main controller 130 compares the density of the toner image of the leading end of the printing sheet 6 with a predetermined reference density and sets a printing start time in which printing starts in accordance with the comparison result. According to an aspect of the invention, the range of the leading end of the printing sheet 6 is set as the initial band B of the printing sheet 6. However, the invention is not limited thereto. That is, the leading end of the printing sheet 6 is not limited to being set as a single band B, and may instead be set as two or more continuous bands B including the initial band B.

After the main controller 130 compares the density of the toner image with the reference density, if the calculated density of the toner image is greater than the reference density, the main controller 130 delays the printing start time of the printing by the time required for a single band B to move past the fixing unit. According to an aspect of the invention, the delay range is set as a single band B, and the delayed printing start time is represented as Ps in FIG. 4. Users are not limited to setting a delay range to a single band B, and can instead set the delay range as two or more bands B. However, when the delay range is set to be too large, it becomes difficult to print all of the printing data on the one printing sheet 6, so users should set the delay range with this consideration in mind.

As shown in FIG. 4, since the printing data is printed from a delayed printing start time Ps, an effective printing region P1 in which the printing data is printed on is reduced. The main controller 130 transmits the printing command to the printer module 160 in order to perform printing on the reduced effective printing region P1, and transmits the printing data from the storage unit 140 to the printer module 160.

The printer module 160 transfers the developed toner image from the delayed printing start time Ps so that the printing sheet 6 passes through the fixing unit. At this time, since printing data is not printed and since a margin, that is, the initial band B, is located in the leading end of the printing sheet 6 that passes between the heating roller 9 and the pressing roller 8 of the fixing unit, the sheet guide member 7 of the fixing unit is not contaminated by the toner image.

The operation of performing printing with the printing start time Ps delayed in accordance with the density of the toner image of the leading end of the printing sheet 6 may be repeated for each printing sheet 6 until the printing is completed. Thus, when a user prints or copies a document which spans two or more printing sheets 6, the density of the toner image for each printing sheet 6 may be calculated.

Figure 5:
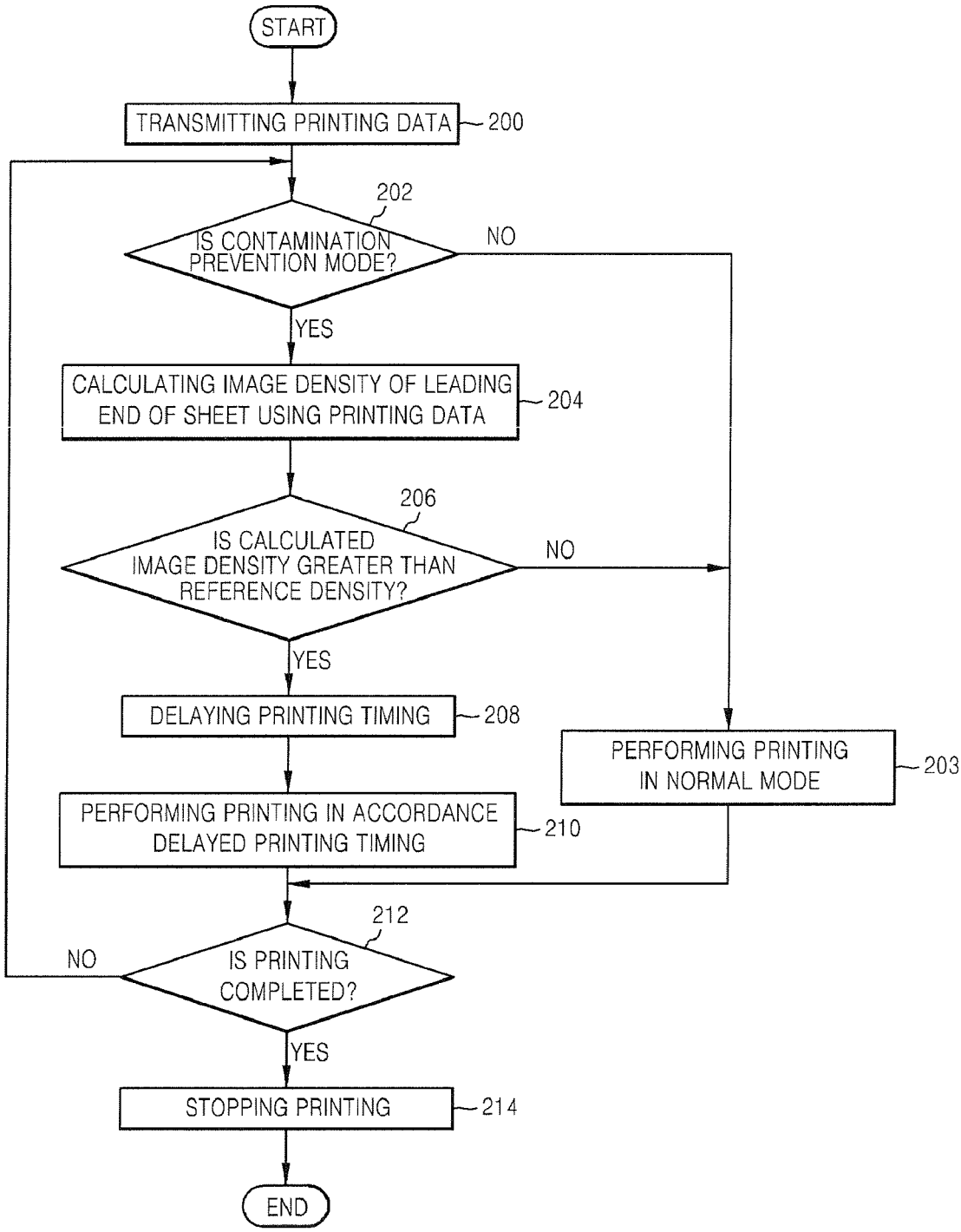
FIG. 5 is a flowchart illustrating a method of preventing the fixing unit from being contaminated using the apparatus illustrated in FIG. 4.

A printing operation will now be described with reference to FIGS. 4 and 5. At operation 200, the host computer 100 transmits the printing data to the main controller 130 through the interface 110. The main controller 130 temporarily stores the printing data received from the host computer 100 in the storage unit 140.

In operation 202, the main controller 130 determines whether a user has set a contamination prevention mode using the manipulator 120 or a remote controller (not shown) to prevent the fixing unit from being contaminated. When the main controller 130 determines that the contamination prevention mode is not set, the printing operation is performed in a normal mode. The "normal mode" refers to performing the printing using a printing start time in which the printing starts at a time which is not delayed. When a printing sheet 6 is printed in the normal mode, the printing is performed on the printing region including the leading end of the printing sheet 6 in operation 203.

When the main controller 130 determines in operation 202 that a user has set the contamination prevention mode, the main controller 130 calculates the density of the toner image of the leading end of the printing sheet 6 using the printing data in operation 204. For example, when the range of the leading end of the printing sheet 6 is set as the initial band B, the density of the toner image is calculated based on the toner consumption required to display the printing data which is going to be printed in the initial band B.

Then, in operation 206, the main controller 130 determines whether the calculated density of the toner image is greater than the predetermined reference density. When the main controller 130 determines that the calculated density of the toner image is greater than the predetermined reference density, the main controller 130 delays the printing start time Ps in operation 208. It is understood that the delay range may include a plurality of continuous bands B including at least the initial band B.

The main controller 130 transmits information on the delayed printing start time Ps to the printer module 160. In operation 210, the printer module 160 performs operations of developing and transferring the printing data so that the printing sheet 6 begins passing through the fixing unit at the delayed printing start time Ps. While the printing is performed, the main controller 130 determines whether a printing termination command is inputted in operation 212. If the main controller 130 determines that a printing termination command has not been input, the operation returns to operation 202.

If the main controller 130 determines that the printing termination command has been input in operation 212, the printing operation is stopped in operation 214.

Meanwhile, when a copying operation is performed in a state where the cover (not shown) is not completely closed, the density of the toner image of the leading end of the printing sheet 6 becomes considerably high and the ink is printed in black when the printing data of the material to be copied is printed.

Figure 6:
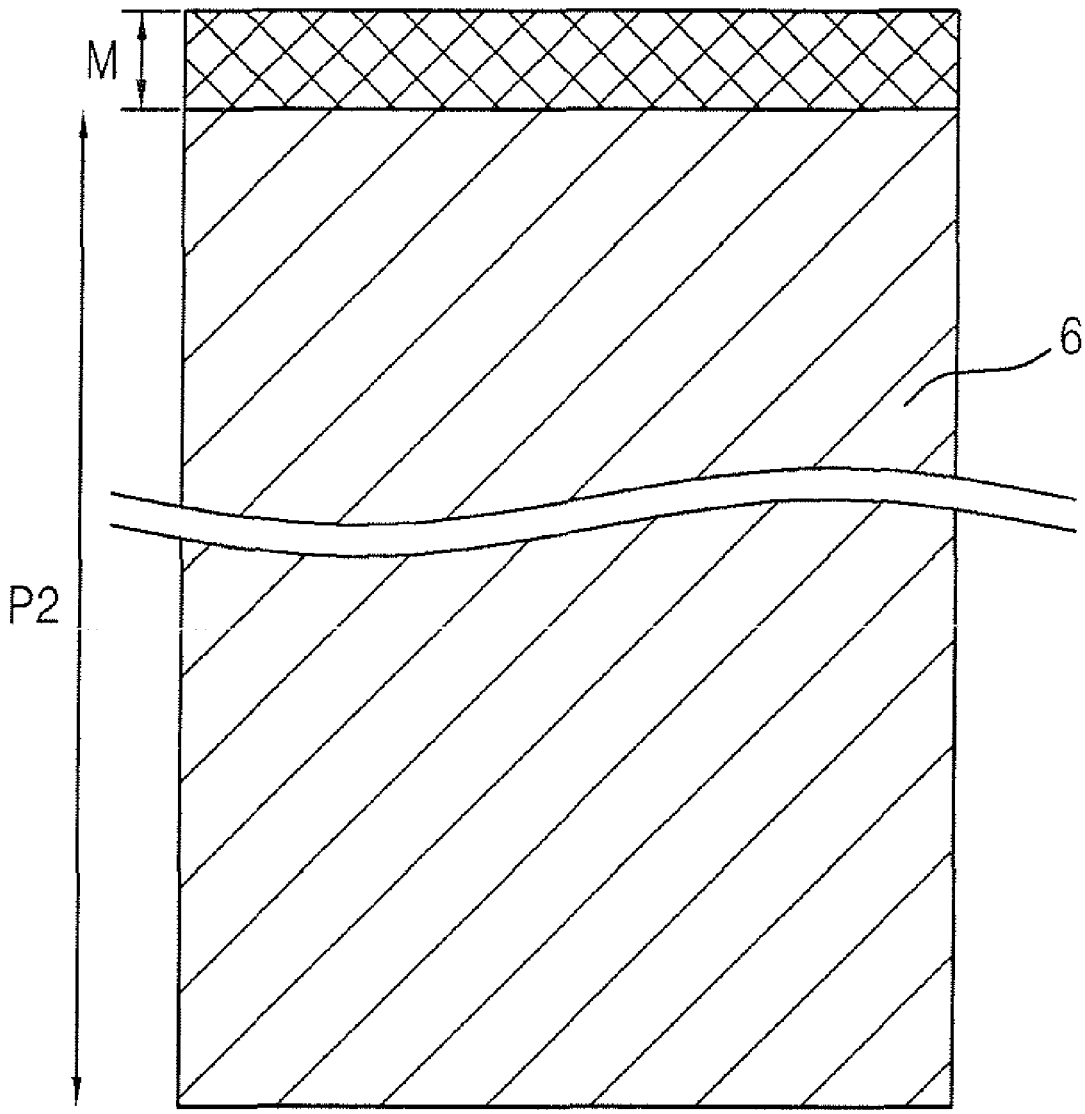
FIG. 6 is a view illustrating an effective printing region in a situation where a leading end of the printing sheet is masked in order to prevent contamination of the sheet guide member, according to another embodiment of the present invention.

In consideration of this problem, the main controller 130 "masks" the leading end of the printing sheet 6 so that the masked leading end is not printed when the cover sensor 151 detects that the cover (not shown) is not completely closed during the printing of the material to be copied. As illustrated in FIG. 6, the printing data corresponding to a mask region M of the printing sheet 6 is deleted so that no printing data is printed in the leading end of the printing sheet 6, leaving only a margin. Therefore, the printing data that is not deleted is printed in the remaining effective printing region P2 excluding the mask region M.

Before the printing is completed, as long as the cover sensor 151 senses that the cover (not shown) is at least partially open, the operation of performing printing with the leading end of the printing sheet 6 masked whenever a printing sheet 6 is printed is repeated.

Figure 7:
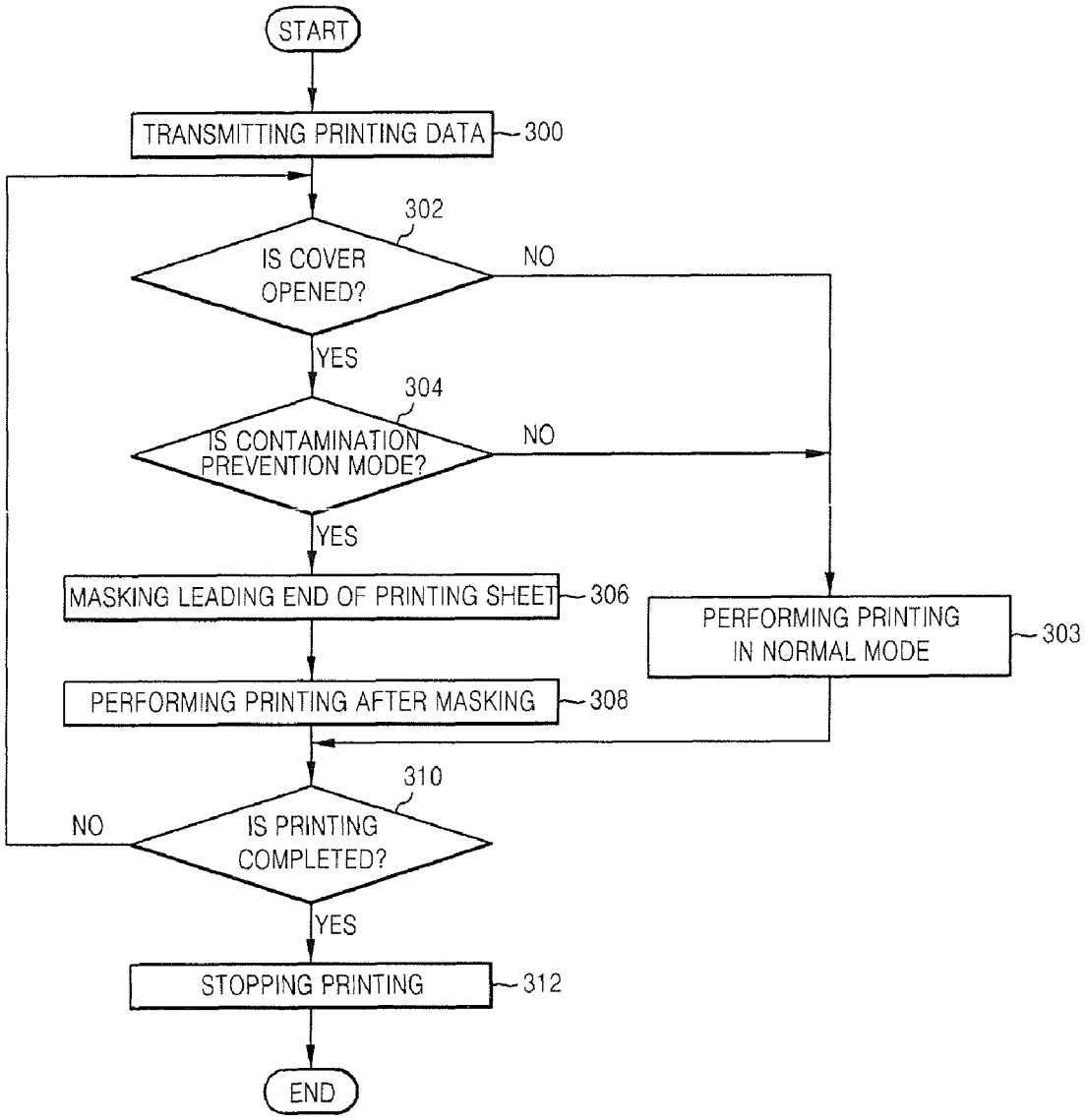
FIG. 7 is a flowchart illustrating a method of preventing a fixing unit from being contaminated using the apparatus illustrated in FIG. 6.

An operation using the apparatus shown in FIG. 5 will be described with reference to FIGS. 6 and 7. First, in operation 300, the main controller 130 temporarily stores the printing data of the material to be copied in the storage unit 140, which is transmitted from a document fed through the copier module 150.

Next, in operation 302, the main controller 130 determines whether the cover (not shown) is opened based on the information detected by the cover sensor 151. When the cover (not shown) is opened, the main controller 130 determines in operation 304 whether a user has set the contamination prevention mode using the manipulator 120 or a remote controller (not shown) in order to prevent the fixing unit from being contaminated. If the main controller 130 determines in operation 304 that the contamination prevention mode has not been set, printing is performed in the normal mode in operation 303.

If the main controller 130 determines in operation 302 that the contamination prevention mode is set, the main controller 130 masks the region corresponding to the leading end of the printing sheet 6 in the printing data received from the copier module 150 in operation 306. That is, the printing data corresponding to the masking region is deleted. It is understood that the printing data corresponding to the masking region need not be entirely deleted, and may instead be altered in some other way, such as, for example, printed in a lighter shade of gray.

Then, the main controller 130 transmits a command to perform printing in the region excluding the masking region to the printer module 160. In operation 308, the printer module 160 develops and transfers the printing data in the effective printing region excluding the masking region so that the printing sheet 6 passes through the fixing unit 308. While the printing is performed, the main controller 130 determines whether a printing termination command has been input in operation 310. When the main controller 130 determines that a printing termination command has not been input, the operation returns to operation 302 in order to continue the printing.

If the main controller 130 determines that the printing termination command has been inputted in operation 310, the printing stops in operation 312.

As described above, according to aspects of the present invention, when the density of the toner image of the leading end of a printing sheet 6 is no less than the predetermined reference density, a printing start time is delayed to prevent the sheet guide member 7 installed in the fixing unit from being contaminated by the toner sludge. Also, according to aspects of the present invention, when the copying operation is performed in a state where the cover (not shown) is not completely closed, for example, due to the carelessness of the user, the printing data of the leading end of the printing sheet 6 is deleted to prevent an unnecessary black color from being printed, and further preventing the sheet guide member 7 of the fixing unit from becoming contaminated by the toner sludge.

Therefore, the apparatus and method according to aspects of the present invention prevent a vertical black line caused by the contamination of the sheet guide member from being printed on the printing sheet 6. Also, the apparatus and method according to aspects of the present invention prevent the printing sheet 6 from getting jammed, thereby improving the reliability of a printing device and a printed product.

Aspects of the invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and a computer data signal embodied in a carrier wave comprising a compression source code segment and an encryption source code segment (such as data transmission through the Internet). For example, the main controller 130 can be embodied as a software program having a predetermined reference density stored therein. The computer readable recording medium can also be distributed over network coupled computer systems so that the computer readable code is stored and executed in a distributed fashion. Also, functional programs, codes, and code segments for accomplishing aspects of the present invention can be easily construed by programmers skilled in the art to which the present invention pertains.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus to prevent a fixing unit of an image forming apparatus from being contaminated, the apparatus comprising:

a host computer to transmit printing data corresponding to material to be printed;

a copier module to transmit copying data corresponding to material to be copied;

a cover sensor to detect whether a cover of the image forming apparatus is closed;

a storage unit to store the printing data transmitted from the host computer and the copying data transmitted from the copier module;

a printer module to print the printing data or the copying data onto a printing sheet;

a fixing unit to fix a toner image corresponding to the printing data or the copying data to the printing sheet;

a sheet guide member to guide the sheet passing through the fixing unit; and a controller to set a printing start time or a printing region according to a density of the toner image to be transferred to a leading end of the printing sheet.

2. The apparatus according to claim 1, wherein the controller delays the printing start time when the density of the toner image is greater than a predetermined reference density.

3. The apparatus according to claim 1, wherein, when the printing data or copying data is printed in a state where the cover is opened, the controller sets the printing region to exclude a masking region corresponding to the leading end of the printing sheet.

4. A method of preventing a fixing unit of an image forming apparatus from being contaminated, the method comprising:

storing printing data received from a host computer;

calculating a density of a toner image to be printed at a leading end of a printing sheet using the printing data;

setting a printing start time according to the calculated density of the toner image; and performing printing according to the set printing start time.

5. The method according to claim 4, wherein the printing start time is delayed when the calculated density of the toner image is greater than a predetermined reference density.

6. The method according to claim 5, wherein the printing start time is a time at which printing is initially performed on the printing sheet.

7. A method of preventing a fixing unit of an image forming apparatus from being contaminated, the method comprising:

storing printing data received from a copier module or a host computer;

detecting whether a cover disposed on the copier module is opened;

excluding a masking region corresponding to a leading end of a printing sheet from a printing region when the printing data is printed in a state where the cover is opened; and printing the printing data according to the set printed region.

8. The method according to claim 7, wherein the excluding of the masking region comprises deleting the printing data of the excluded masking region.

9. An image forming apparatus, comprising:

a printer module to transfer printing data onto a printing sheet as a toner image; and a controller which detects printing conditions and controls the printer module to print the toner image corresponding to a leading end of the printing sheet according to the printing conditions.

10. The image forming apparatus of claim 9, wherein the printing conditions comprise a density of the toner image corresponding to the leading end of the printing sheet.

11. The apparatus of claim 10, wherein if the detected toner image density is greater than a predetermined reference density, the toner image corresponding to the leading end of the printing sheet is not printed at the leading end of the printing sheet.

12. The apparatus of claim 11, wherein the toner image corresponding to the leading end of the printing sheet is not printed by delaying a printing start time at which the toner image will start to be transferred onto the printing sheet.

13. The image forming apparatus of claim 9, wherein the printing conditions comprise a state of whether a cover disposed on the image forming apparatus is opened.

14. The image forming apparatus of claim 13, wherein if the cover is detected to be opened, the controller prevents the printer module from transferring the toner image onto the leading end of the printing sheet, and otherwise, does not prevent the printer module from transferring the toner image onto the leading end of the printing sheet.

15. The image forming apparatus of claim 14, wherein the controller prevents the printer module from transferring the toner image onto the leading end of the printing sheet by deleting printing data corresponding to the leading end of the printing sheet.

16. The image forming apparatus of claim 13, wherein if the cover is detected to be opened, the controller controls the printer module to transfer the toner image onto the leading end of the printing sheet in a lighter shade than an original shade of the toner image corresponding to the leading end of the printing sheet.

* * * * *